US009260830B2

(12) United States Patent
Schneider

(10) Patent No.: US 9,260,830 B2
(45) Date of Patent: Feb. 16, 2016

(54) FLOOD BAG

(71) Applicant: Steve Schneider, Decatur, GA (US)

(72) Inventor: Steve Schneider, Decatur, GA (US)

( * ) Notice: Subject to any disclaimer, the term of this patent is extended or adjusted under 35 U.S.C. 154(b) by 0 days.

(21) Appl. No.: 14/186,638

(22) Filed: Feb. 21, 2014

(65) Prior Publication Data

US 2015/0240435 A1 Aug. 27, 2015

(51) Int. Cl.
*E02B 3/10* (2006.01)
*E02B 3/12* (2006.01)

(52) U.S. Cl.
CPC ..... *E02B 3/108* (2013.01)

(58) Field of Classification Search
USPC ..... 405/15–20, 110–111, 107, 114, 302.6; 383/67, 98, 99, 125
See application file for complete search history.

(56) References Cited

U.S. PATENT DOCUMENTS 8,672,585 B2 3/2014 Schnaars, Sr. et al.
2006/0275084 A1* 12/2006 Harbeck ..... 405/116
2007/0140598 A1* 6/2007 McGillick et al. ..... 383/22
2012/0230766 A1 9/2012 Schnaars, Sr. et al.
2013/0094905 A1 4/2013 Schnaars, Sr. et al.
2014/0102581 A1* 4/2014 Adams ..... 141/10

FOREIGN PATENT DOCUMENTS

DE 10326802 A1 * 1/2005
EP 2532789 A1 * 12/2012
RU 2459904 C1 * 8/2012

* cited by examiner

*Primary Examiner* — Sunil Singh
(74) *Attorney, Agent, or Firm* — Thomas | Horstemeyer, LLP

(57) ABSTRACT

An apparatus, system, and method for creating a flood barrier by use of an open-top fabric bag device or series of connected bag devices that can be filled with materials to create the barrier. Each bag has a bottom panel, a front panel, a back panel, a four-sided neck, an opening in the neck, and lifting loops at the neck for lifting the bag. The bottom panel may contain a closable aperture formed by a front bottom panel overlapping a back bottom panel underneath the back bottom panel and secured by a fastening device to releasably secure the aperture. When the bag is full of materials and is lifted at the neck loops, the aperture opens and the contents are released and remain in place as the bag is lifted and removed and is available for re-use.

20 Claims, 7 Drawing Sheets

FLOOD BAG

BACKGROUND

Various types of devices may be used to prevent or defend against flooding of areas or structures. Many such devices, such as traditional sand bags, may be filled with materials and stacked to create a wall or barrier against flood waters. However, sand bag barriers require inordinate amounts of labor to create large flood protection barriers that require tall barriers or barriers that extend laterally for protracted lengths. The present invention is a bag designed for emergency flood protection by an individual consumer, such that it can be easily deployed, filled, and positioned. The present invention provides for ease of use by the consumer, such that the consumer can fill the bag at a rapid rate and position the bag is a safer manner than other flood protection bag currently on the market. Additionally, the present invention can be can be broken down by the consumer by use of an opening component on the bottom of the bag and therefore constitutes a one-piece, reusable flood bag.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

The present disclosure generally relates to apparatus, devices, and systems for providing protection of areas and structures from flood waters. More specifically, the present disclosure discloses an apparatus that can be readily deployed, easily filled and attached to like apparatuses to create a floodwater barrier of a desired lateral length. In addition, each apparatus can be easily emptied and removed from the barrier to be reused in a subsequent application.

Figure 1:
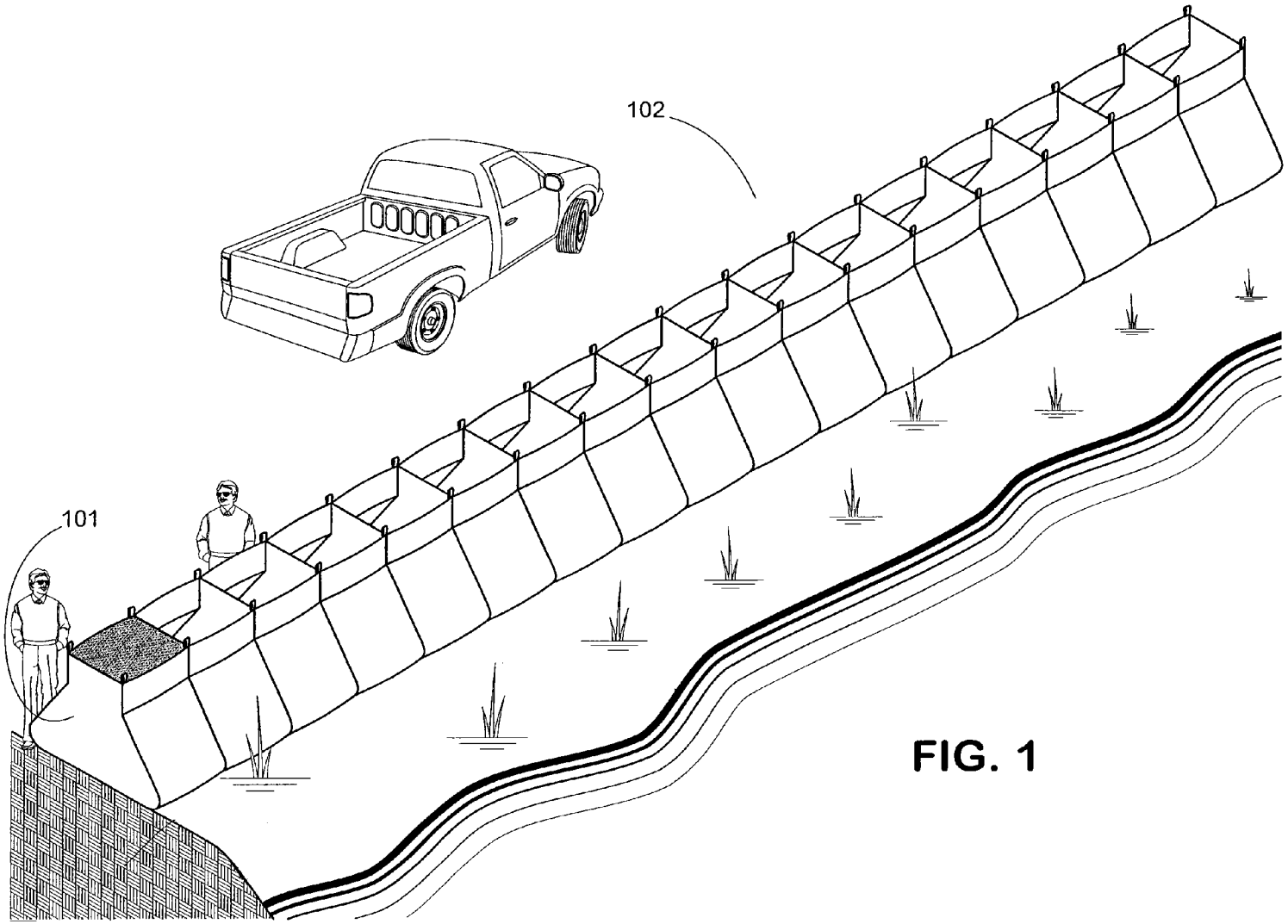
FIG. 1 is an overhead perspective view of an exemplary deployment of a series of seventeen flood bag devices in an in-use configuration comprising a wall of the devices that provide a barrier against flood waters in accordance with various embodiments of the present disclosure.

In the following discussion, a general description of the embodiments of a flood bag apparatus for creating a variable-length flood barrier is provided. With reference to FIG. 1, shown is a drawing of an example of an exemplary deployment of a series of seventeen flood bag devices [101] in an in-use configuration. As depicted in FIG. 1, each flood bag [101] is aligned with an adjoining flood bag and releasably connected to another flood bag to create a configured barrier or wall [102] of flood bags. The wall [102] of flood bags [101] provides an extended barrier against flood waters. In some embodiments, the wall [102] of flood bags [101] may be positioned on a slope of terrain above potentially encroaching flood waters.

Figure 2:
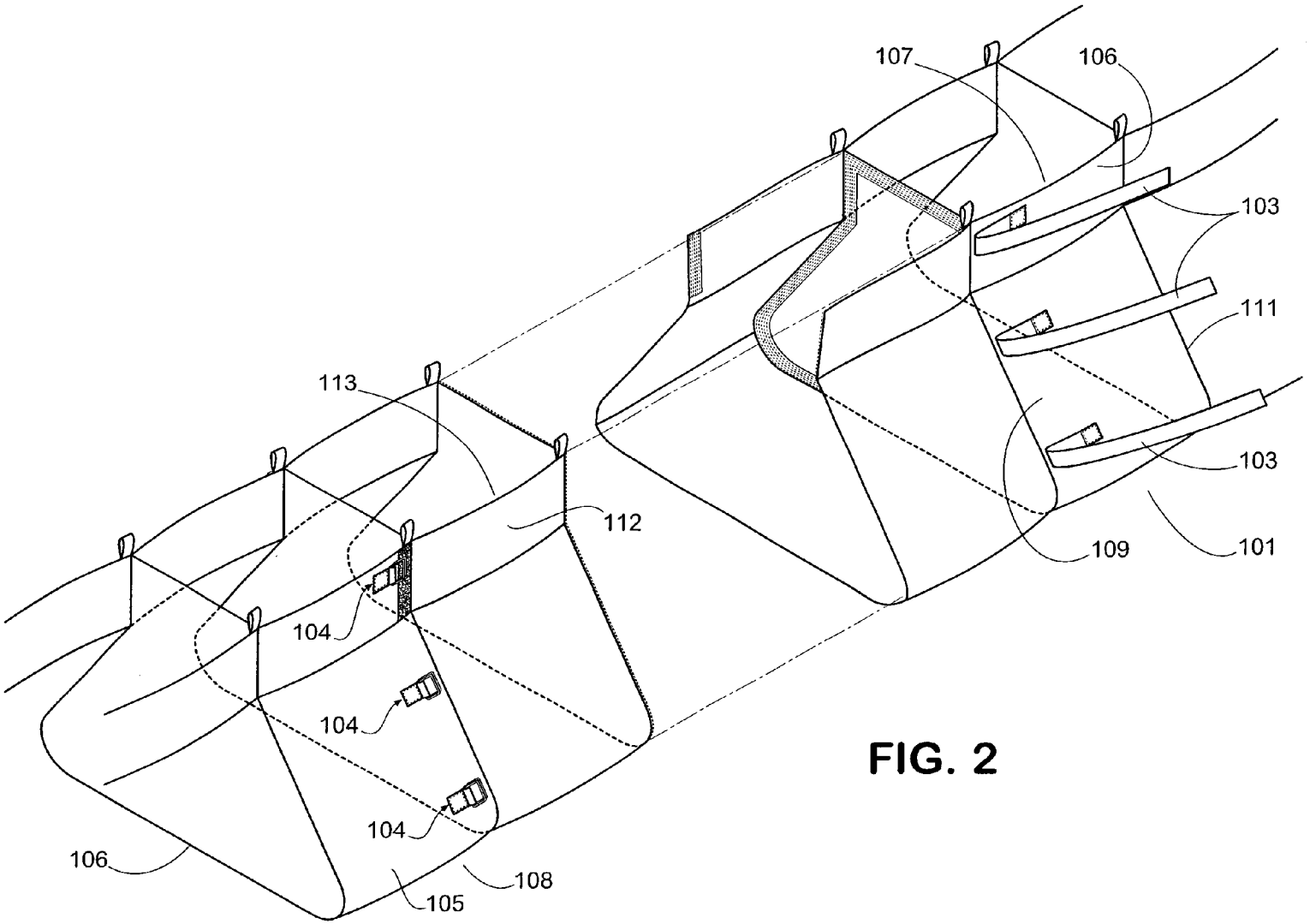
FIG. 2 is a perspective view of the linear configuration of FIG. 1 showing the attachment of multiple flood bag devices to other flood bags by means of a series of straps integrated into the front face of the bags in accordance with various embodiments of the present disclosure.

Referring next to FIG. 2, shown is a detailed perspective view of the linear configuration of FIG. 1 showing the attachment of multiple flood bags [101] to other flood bags by, for example, employing a series of straps [103] and buckles [104] integrated into the front face [105] of the bags [101]. As shown in FIG. 2, in embodiments there may be a series of straps [103] integrated into face [105] of bag [101], and the straps may be aligned vertically. As further shown in FIG. 2, in embodiments one or more of the straps [102] may be positioned on the face [106] of the neck [107] of bag [101], and the remaining straps [103] may be positioned on the face [109] of the body [110] of bag [101]. As further shown in FIG. 2, in embodiments a corresponding bag [108] to which the bag [101] is attached may be have a series of buckles [104] integrated into face [105] of bag [108], and the buckles may be aligned vertically. As further shown in FIG. 2, in embodiments one of the buckles [104] may be positioned on the face [112] of the neck [113] of bag [108], and the remaining buckles [104] may be positioned on the face [105] of the body [106] of bag [108].

Figure 3:
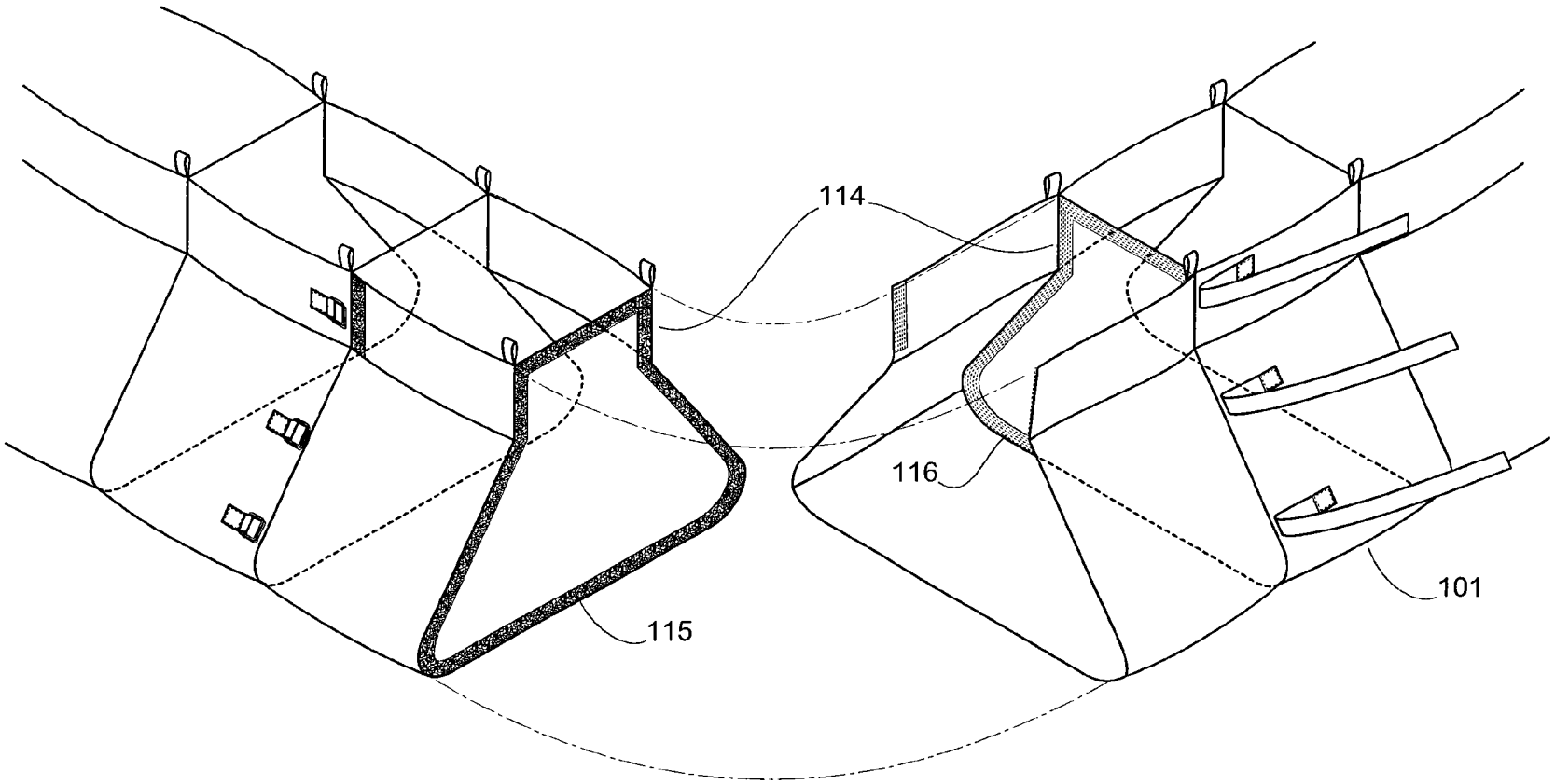
FIG. 3 is a perspective view of a variation of the configuration of FIG. 2 showing the attachment of multiple flood bag devices to other flood bags by additional means of hook-and-loop fasteners, such as Velcro®, in accordance with various embodiments of the present disclosure.

Referring to FIG. 3, shown is a drawing of a variation of the configuration of FIG. 2 showing the attachment of multiple flood bag devices to adjoining flood bags by additional means of hook-and-loop fasteners [114], such as Velcro®. As depicted in FIG. 3, in embodiments a first bag [114] may have the "hook" side [115] of the attachment on a side of the bag, and the adjoining bag [101] may have the "loop" side [116] of the attachments on a side of the bag [101] that abuts first bag [114]. The attaching of multiple bags is to ensure that the bags are properly aligned and adjoined—without any gaps—before filling of the bags with filling material. In embodiments, first bag [114] may be sewn to second bag [101] in order to attach adjoining bags [114] and [101]. In other embodiments, each of bags [101], [108] and [114] may each be sewn to adjoining bags to attach multiple bags for the purpose of forming a multiple-bag barrier or wall.

Figure 4:
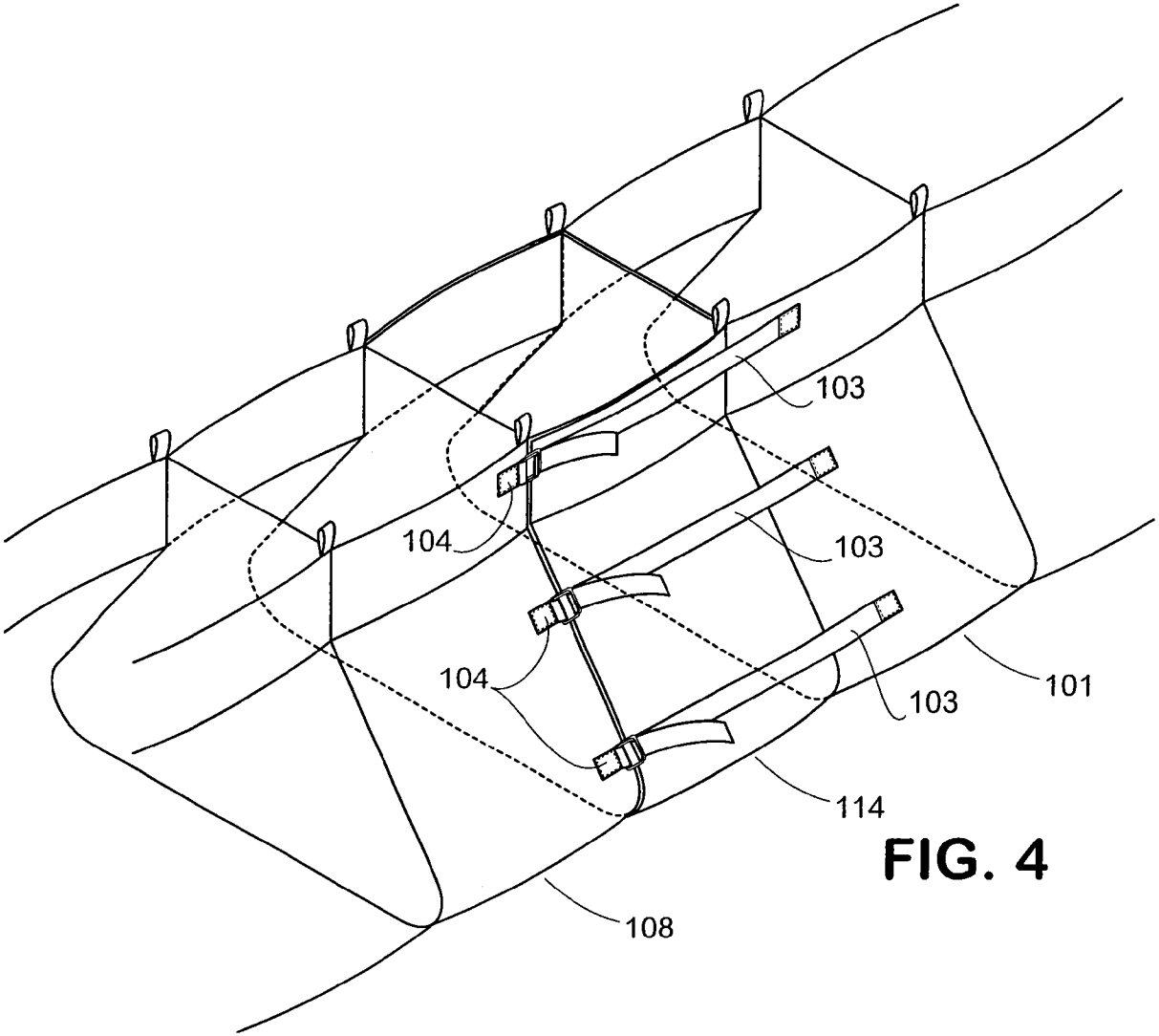
FIG. 4 is a close-up perspective view of the exemplary configurations of FIG. 2 and FIG. 3 showing a detail of the connection of multiple flood bag devices in accordance with various embodiments of the present disclosure.

Looking to FIG. 4, shown are the exemplary configurations of FIG. 2 and FIG. 3 showing in additional detail the connection of multiple flood bags [101], [108], and [114] with the hook-and-loop attachments of adjoining bags engaged and the straps [103] and buckles [104], respectively of attached bags [101] and [108] engaged. In embodiments, every adjoining bag may be attached with hook-and-loop attachments, and every other bag may be adjoined with straps and buckles.

Figure 5:
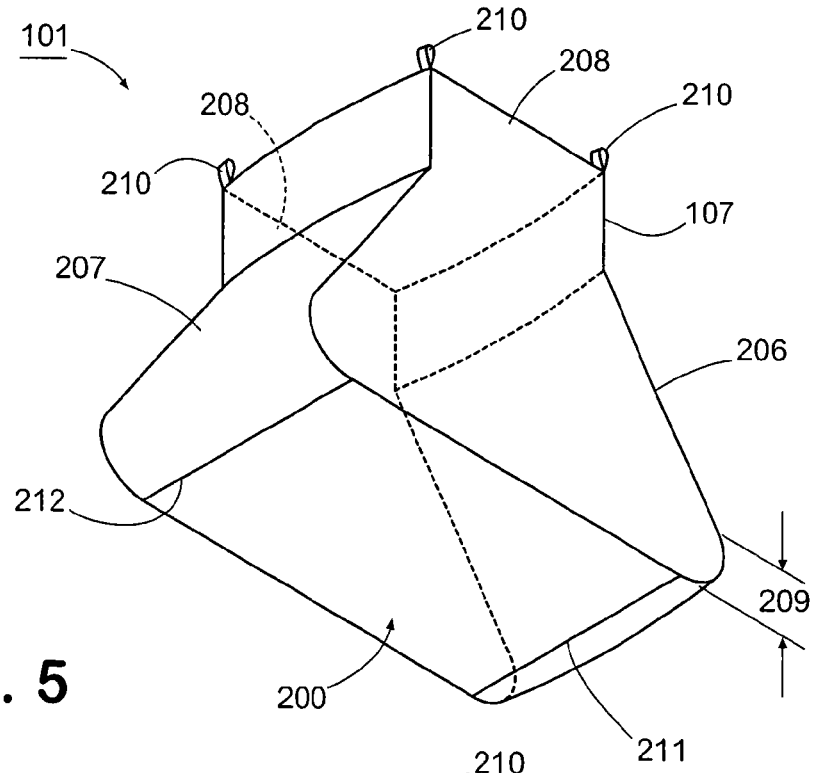
FIG. 5 is a perspective view of an individual flood bag from the configurations of FIG. 1, FIG. 2, FIG. 3 and FIG. 4 showing the various side, bottom and neck panels of the bag.
Figure 6:
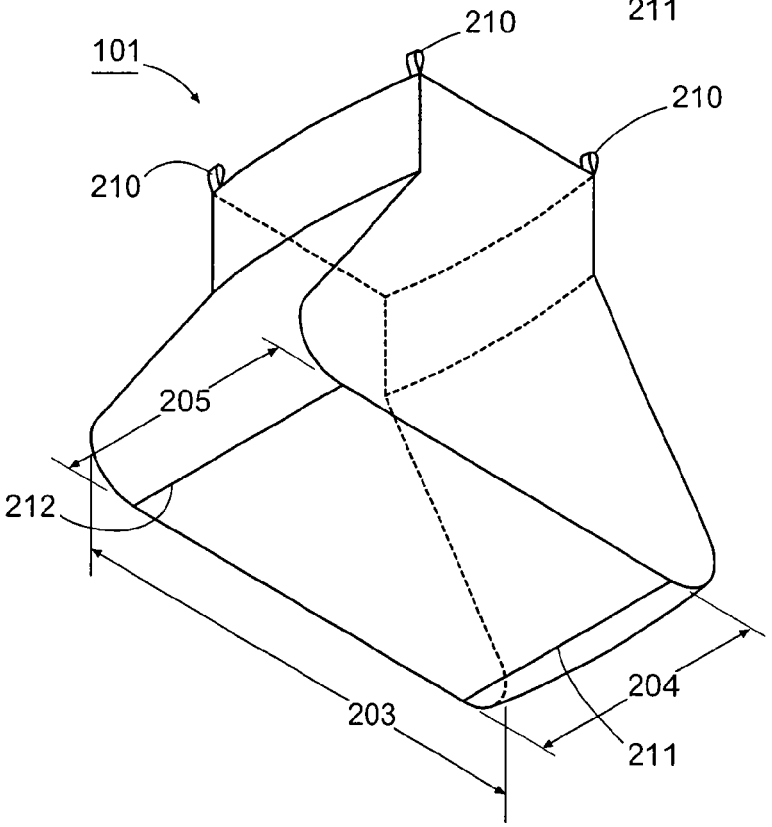
FIG. 6 is a perspective view of the individual flood bag shown in FIG. 5 showing the various side and bottom dimensions.

FIG. 5 and FIG. 6 depict perspective view of an individual flood bag [101] from the configurations of FIG. 1, FIG. 2, FIG. 3 and FIG. 4 showing the various side, bottom and neck panels and side and bottom dimensions of the bag [101]. With further reference to the examples illustrated in FIGS. 5-6, bag [101] may be constructed of a woven material consisting of polypropylene or may be coated with a polyethylene or polypropylene coating to enhance its imperviousness to water or to strengthen the bottom [200] or sides [206], [207], and [208] of bag [101]. In embodiments, the bottom [200] of bag [101] is approximately 72 inches wide at side width [203], with front [204] and rear [205] side lengths of approximately 24 inches when filled, and front and rear "toes" [209] formed at a junction [211] of front wall panel [206] and bottom panel [200] and a junction [212] of back wall panel [207] and bottom panel [200] and measuring approximately 12 inches in height. In embodiments, the top of bag neck [107] is square-shaped, with each side [208] approximately 30 inches. In embodiments, the total height of bag [101] is approximately 48 inches when filled. In other embodiments, the height of bag [101] may vary up to approximately 72 inches when filled, with the same respective ratios of side widths [204] and [205], side lengths [203], front and rear "toe" heights [209], and bag neck sides [208]. Also in embodiments, bag [101] has four bag neck loops [210], one at each corner of the top of neck [105].

Figure 7:
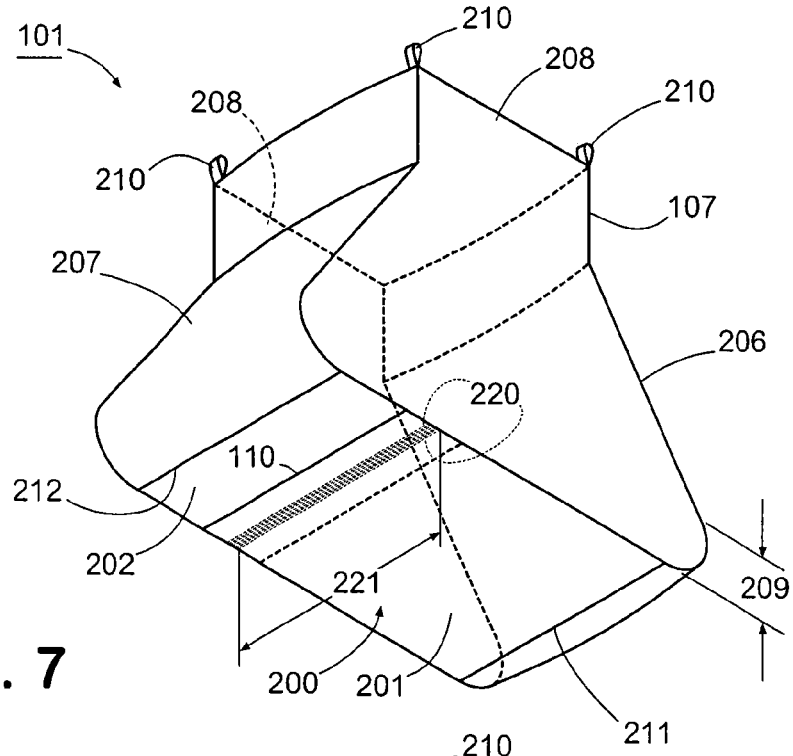
FIG. 7 is a perspective view of another individual flood bag from the configurations of FIG. 1, FIG. 2, FIG. 3 and FIG. 4 showing a closed aperture on the bottom of the bag in accordance with various embodiments of the present disclosure.
Figure 8:
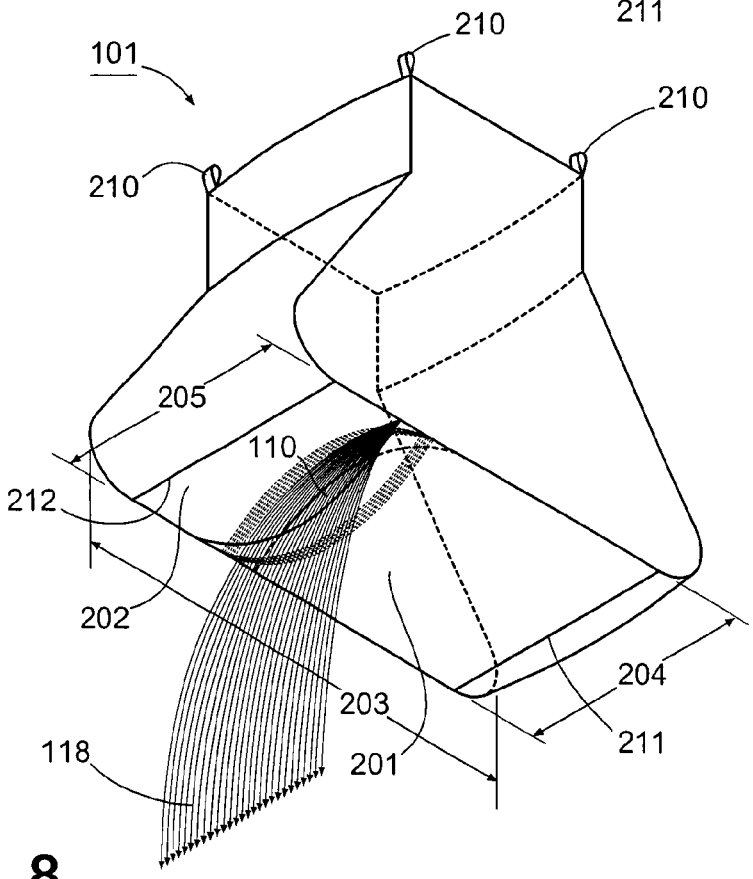
FIG. 8 is a perspective view of the individual flood bag shown in FIG. 7 and further showing the opening of the aperture on the bottom of the bag that allows the contents of the bag to be emptied by way of the opened aperture in accordance with various embodiments of the present disclosure.

Referring next to FIG. 7 and FIG. 8, shown are perspective views of another embodiment of an individual flood bag [101] from the configurations of FIG. 1, FIG. 2, FIG. 3 and FIG. 4 showing the optional closeable aperture [110] on the bottom [200] of bag [101]. Closeable aperture [110] allows for removal of bag [101] from its internal filling contents [118] without having to first remove the filling contents [118] from bag [101]. Aperture [110] is formed by two overlapping panels and [202] at bottom [200] of bag [101], with front bottom panel [201] overlapping rear panel [202] underneath rear bottom panel [202], such that flood water approaching front of bag [101] is deflected under aperture [110]. In embodiments, aperture [110] is closed and secured by hook-and-loop fasteners [220], such as Velcro®. In embodiments, width [221] of hook-and-loop fastener [220] is approximately one inch, and fastener [220] runs along entire width [222] of bottom [201] of bag [101]. In other embodiments, width [221] of hook-and-loop fasteners [220] is sufficient in width to keep the aperture closed when the bag is being filled. In embodiments, the ability to remove bag [101] from internal filling contents [118] allows for removal and storage of bag [101] and re-use of bag [101] for future applications.

With further reference to the examples illustrated in FIGS. 7-8, bag [101] may be constructed of a woven material consisting of polypropylene or may be coated with a polyethylene or polypropylene coating to enhance its imperviousness to water or to strengthen the bottom [200] or sides of bag [101]. In embodiments, the bottom [200] of bag [101] is approximately 72 inches wide at side width [203], with front [204] and rear [205] side lengths of approximately 24 inches when filled, and front and rear "toes" [209] formed at the junction [211] of front wall panel [206] and bottom front panel [201] and the junction [212] of back wall panel [207] and rear bottom panel [202] and measuring approximately 12 inches in height. In embodiments, the top of bag neck [107] is square-shaped, with each side [208] approximately 30 inches. In embodiments, the total height of bag [101] is approximately 48 inches when filled. In other embodiments, the height of bag [101] may vary up to approximately 72 inches when filled, with the same respective ratios of side widths [204] and [205], side lengths [203], front and rear "toe" heights [209], and bag neck sides [208]. Also in embodiments, bag [101] has four bag neck loops [210], one at each corner of the top of neck [105].

With reference to FIG. 8, in embodiments, when filled bag [101] is lifted at one or more of loops [210], the aperture [110] closures [221] release and allow the filling contents [118] of bag [101] to be released through aperture [110], causing bag [101] to empty and allowing for the removal, storage and re-use of bag [101].

Figure 9:
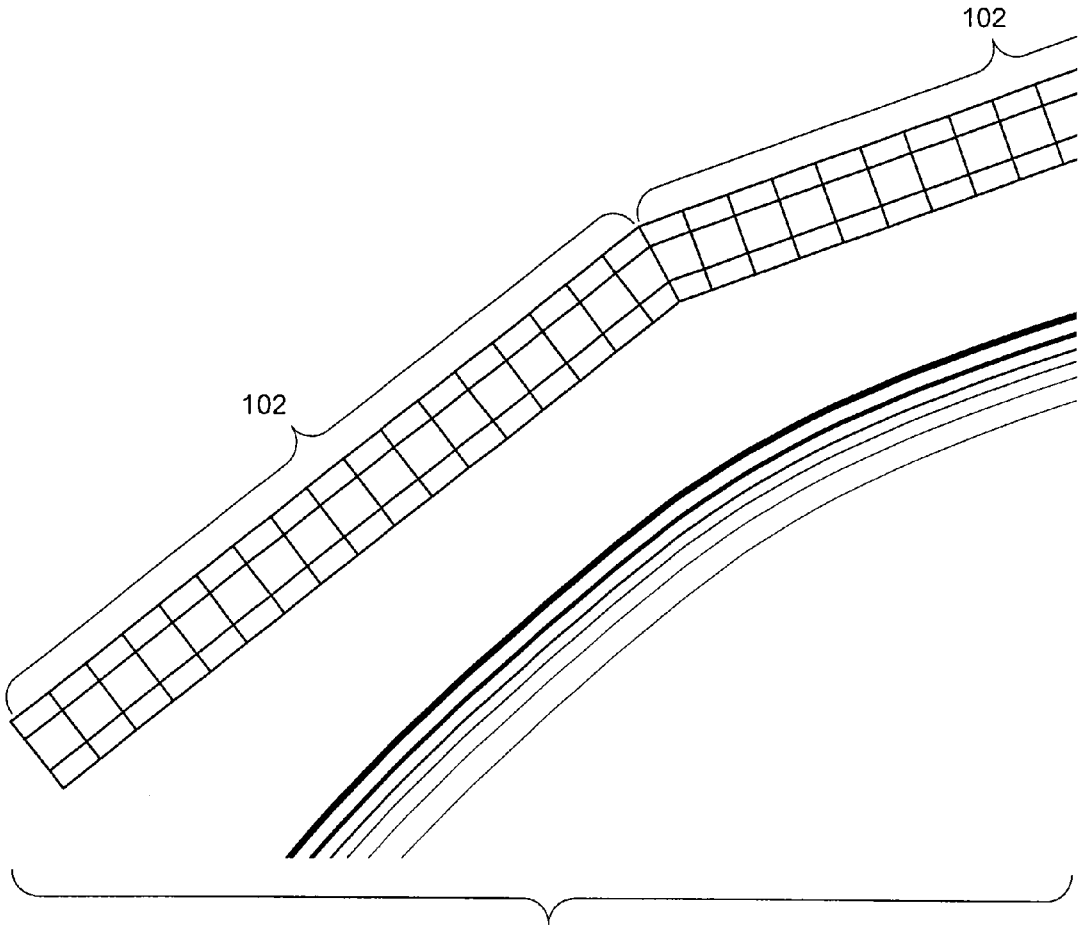
FIG. 9 is an overhead perspective view from a removed distance of several sets of configurations of the flood bag devices shown in FIG. 1 that are conjoined to form a protracted wall of the devices in accordance with various embodiments of the present disclosure.

Referring to FIG. 9, shown is an optional serial connection of several sets of configurations [102] of bags [101] shown in FIGS. 1-8. In embodiments, each cell set configuration [102] of bags [101] comprise a plurality of bags [101]. In embodiments, multiple cell sets [102] are conjoined to form an extended or protracted wall [310] of bags [101] of a desired or effective length. In embodiments, multiple cell sets [102] are conjoined to provide a protracted wall [310] of bags [101] of up to 110 feet in length.

Figure 10:
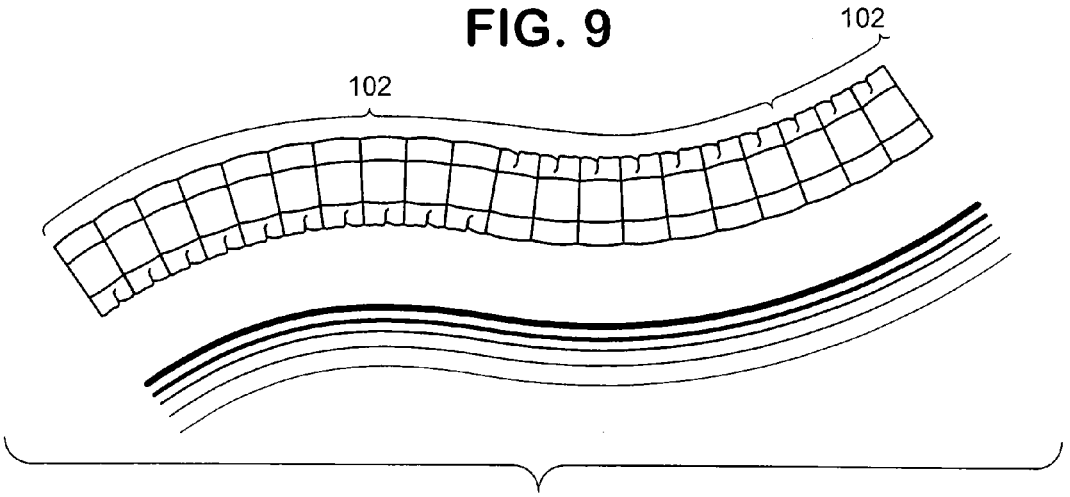
FIG. 10 is an overhead perspective view from a removed distance of several sets of configurations of the flood bag devices shown in FIG. 1 that are conjoined to form a protracted wall of the devices in a curved alignment in accordance with various embodiments of the present disclosure.

FIG. 10 depicts another embodiment of a serial connection of a plurality of bags [101] shown in FIGS. 1-8. In embodiments, bags [101] are conjoined to form a protracted wall of the plurality of bags [101] in a variably curved alignment in accordance with various embodiments of the present disclosure. In embodiments, the curvature of the wall is achieved by partially filling one or more bags [101] such that the front side [206] or back side [207] of the bags [101] may be folded or creased to achieve the desired degree of curvature.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus for restraining flood water, comprising:

a bag device, wherein the bag device has:

a bottom panel, wherein the bottom panel comprises:

a front bottom panel;

a back bottom panel; and a closable aperture at a junction of the front bottom panel and the back bottom panel through which the contents of the bag device may be released when the bag device is lifted at one or more lifting loops, wherein the closable aperture is covered by overlapping the front bottom panel underneath the back bottom panel;

a first side panel substantially parallel to a second side panel, the first and second side panels being connected to the bottom panel;

a front panel;

a back panel;

an elongated neck comprised of respective upper portions of the first and second side panels, the front panel, and the back panel, wherein the elongated neck forms an opening at a top of the bag device;

wherein at least one of the one or more lifting loops is connected to at least one corner of the elongated neck; and formable toes at the junction of the bottom panel with each of the front and back panels, the formable toes comprising a curved outer-surface extending outward from the bag device.

2. The apparatus of claim 1, wherein the bag device has on the outside of the first side panel an attachment means for attaching to an adjoining bag, and the bag device has on the outside of the second side panel an attachment means for attaching to a second adjoining bag.

3. The apparatus of claim 2, wherein the bag device has integrated into the front panel a series of straps for attachment to a first non-immediately adjoining bag.

4. The apparatus of claim 2, wherein the bag device has integrated into the front panel a series of buckles for attachment to a first non-immediately adjoining bag.

5. The apparatus of claim 1, wherein the bag device has integrated into its front panel a series of straps for attachment to a second bag.

6. The apparatus of claim 1, wherein the bag device has integrated into the front panel a series of buckles for attachment to a second bag.

7. The apparatus of claim 1, wherein the closable aperture is secured in a closed position with hook-and-loop fasteners.

8. The apparatus of claim 1, wherein the first side panel is substantially identical in shape with respect to the second side panel, and the front panel is substantially identical in shape with respect to the back panel.

9. A system for creating a floodwater barrier, comprising:

a plurality of bags, wherein each bag has:

a bottom panel, wherein the bottom panel comprises:

a front bottom panel;

a back bottom panel; and a closable aperture at a junction of the front bottom panel and the back bottom panel through which the contents of the bag may be released when the bag is lifted at one or more lifting loops, wherein the closable aperture is covered by overlapping the front bottom panel underneath the back bottom panel;

a first side panel substantially parallel to a second side panel, the first and second side panels being connected to the bottom panel;

a front panel;

a back panel;

an elongated neck comprised of respective upper portions of the first and second side panels, the front panel, and the back panel, wherein the elongated neck forms an opening at a top of the bag;

wherein at least one of the one or more lifting loops is connected to at least one corner of the elongated neck;

formable toes at the junction of the bottom panel with each of the front and back panels, the formable toes comprising a curved outer-surface extending outward from the bag; and wherein each bag is connected to an adjoining bag with at least one side panel.

10. The system of claim 9, wherein each bag is connected to one or more adjoining bags by an attachment means on the outside of the first side panel and an attachment means on the outside of the second side panel.

11. The system of claim 9, wherein one or more bags is connected to one or more other bags by means of strap-and-buckle attachments integrated into the front panels of respective attached bags.

12. The system of claim 9, wherein:

each bag is connected to one or more adjoining bags by an attachment means on the outside of the first side panel and an attachment means on the outside of the second side panel; and one or more bags is connected to one or more other bags by means of strap-and-buckle attachments integrated into the front panels of respective attached bags.

13. The system of claim 9, wherein a plurality of sets of adjoined bags are attached to one another to extend the length of the barrier beyond the width of one the sets of adjoined bags.

14. The system of claim 9, wherein the elongated neck forms a square opening at the top of the bag.

15. A method for creating a removable floodwater barrier, comprising:

attaching together in a lateral alignment a plurality of flood bag devices, wherein each bag has:

a bottom panel, wherein the bottom panel comprises:

a front bottom panel;

a back bottom panel; and a closable aperture at a junction of the front bottom panel and the back bottom panel through which the contents of the bag may be released when the bag is lifted at one or more lifting loops, wherein the closable aperture is covered by overlapping the front bottom panel underneath the back bottom panel;

a first side panel substantially parallel to a second side panel, the first and second side panels being connected to the bottom panel;

a front panel;

a back panel;

an elongated neck comprised of respective upper portions of the first and second side panel, the front panel, and the back panel wherein the elongated neck forms an opening at a top of the bag;

wherein at least one of the one or more lifting loops is connected to at least one corner of the elongated neck;

formable toes at the junction of the bottom panel with each of the front and back panels, the formable toes comprising a curved outer-surface extending outward from the bag; and an attachment means on the outside of each side panel for attaching to one or more adjoining bags; and filling each of the bags with soil, rocks or other filling contents.

16. The method of claim 15, further comprising connecting one or more non-immediately adjoining bags by means of strap-and-buckle attachments integrated into the front panels of the respective attached bags.

17. The method of claim 15, further comprising attaching a plurality of sets of attached bags to extend the length of the barrier beyond the width of one of the sets of attached bags.

18. The method of claim 17, further comprising partially filling one or more bags such that the front or side of one or more bags may be folded or creased to achieve a desired one or more curvatures in the barrier.

19. The method of claim 15, further comprising lifting the bag at the one or more lifting loops, wherein the closable aperture is opened by the weight of the contents and the contents are released out of the bag through the closable aperture as the bag is lifted.

20. The method of claim 15, wherein the elongated neck forms a square opening at the top of the bag.

* * * * *